US005235940A

United States Patent [19]

Nakatani

[11] Patent Number: 5,235,940

[45] Date of Patent: Aug. 17, 1993

[54] ENGINE VALVE DRIVING APPARATUS

[75] Inventor: Shuichi Nakatani, Hiroshima, Japan

[73] Assignee: Mazda Motor Corporation, Hiroshima, Japan

[21] Appl. No.: 2,345

[22] Filed: Jan. 6, 1993

[30] Foreign Application Priority Data

Jan. 20, 1992 [JP] Japan ..... 4-030119

[51] Int. Cl.[5] ..... F01L 1/34

[52] U.S. Cl. ..... 123/90.16; 123/90.27; 123/90.23

[58] Field of Search ..... 123/90.15, 90.16, 90.22, 123/90.23, 90.27, 90.39

[56] References Cited

U.S. PATENT DOCUMENTS

| | | | |
|---|---|---|---|
| 4,561,391 | 12/1985 | Simko | 123/90.27 |
| 4,638,774 | 1/1987 | Aoi | 123/90.27 |
| 4,649,874 | 3/1987 | Sonoda et al. | 123/90.23 |
| 4,662,323 | 5/1987 | Moriya | 123/90.23 |
| 4,883,027 | 11/1989 | Oikawa et al. | 123/90.16 |
| 4,905,639 | 3/1990 | Konno | 123/90.16 |
| 5,042,438 | 8/1991 | Heil | 123/90.27 |
| 5,070,824 | 12/1991 | Morishita | 123/90.23 |
| 5,184,579 | 2/1993 | Fujiwara | 123/90.23 |

FOREIGN PATENT DOCUMENTS

| | | |
|---|---|---|
| 62-154210 | 9/1987 | Japan . |
| 63-117109 | 5/1988 | Japan . |

*Primary Examiner*—E. Rollins Cross
*Assistant Examiner*—Weilun Lo
*Attorney, Agent, or Firm*—Keck, Mahin & Cate

[57] ABSTRACT

The invention discloses a valve driving apparatus for use of an engine including an intake valve for opening and closing an intake port, an exhaust valve for opening and closing an exhaust port, and intake and exhaust cam shafts for driving the intake and exhaust valves respectively, at least one of the intake and exhaust valves being adapted to be driven by a cam shaft located on the other side with respect thereto.

7 Claims, 6 Drawing Sheets

ENGINE VALVE DRIVING APPARATUS

BACKGROUND OF THE INVENTION

The invention relates to a valve driving apparatus for use of an engine, including a plurality of intake valves driven via a swing arm by intake cams provided on an intake cam shaft and a plurality of exhaust valves driven via a swing arm by exhaust cams provided on an exhaust cam shaft. For instance, the invention can apply to a five-valves engine having three intake valves and two exhaust valves.

RELATED ART STATEMENT

A four-cycle reciprocating type engine having five valves comprising three intake valves and two exhaust valves to enhance intake and exhaust efficiency, follow-up ability during high speed driving and permitable maximum revolution per minute is presently known as disclosed in Japanese Utility Model Public Disclosure No. 62-154210.

In addition, Japanese Patent Public Disclosure No. 63-117109 discloses a valve driving system which can adjust valve opening and closing timing of intake and exhaust valves and valve lift according to the driving state of an engine.

An intake cam shaft in this valve driving system is provided with two cams each for high speed and low speed. Lifters disposed between these two cams and upper ends of valve stems have pistons therein acting as a connector which is hydraulically driven. The valve driving system drives intake valves in accordance with cam profile of the high speed cam when the piston is operated, namely during high speed so that the intake valves open at early timing and close at late timing, and increase the valve lift, while the valve driving system drives intake valves in accordance with cam profile of the low speed cam when the piston is not operated, namely during low speed so that the intake valves open at late timing and close at early timing, and decrease valve lift. Thus, this system can vary filling rate of air-fuel mixture to be introduced into a combustion chamber in accordance with the driving state of an engine.

In recent years, aforementioned apparatus or system tend to be used in combination for the purpose of increasing engine power. However, the combination of multiple valve system and valve driving system causes the valve driving arrangement disposed in a valve driving chamber to be complicated and thereby the valve driving chamber tends to be larger.

SUMMARY OF THE INVENTION

It is therefore an object of the present invention to provide a valve driving apparatus for use of an engine having a plurality of valves for driving intake and exhaust valves from advantageous side with respect to valve layout to enhance valve layout allowability and make the valve driving chamber to be compact.

A further object of the present invention is to provide a valve driving apparatus for use of an engine having a plurality of valves capable of increasing valve layout allowability even if a valve driving system is provided when valve stems of the valves have different inclination angle.

It is another object of the present invention to provide a valve driving apparatus for use of an engine having a plurality of valves capable of increasing positioning allowability of swing arms which drive intake and/or exhaust valves by a cam shaft located at the other side with respect thereto.

Still another object of the invention is to provide a valve driving apparatus for use of an engine in which one of three intake or exhaust valves is disposed at one end of the three valves configuration and is formed as having constant valve timing and valve lift so that swirls are facilitated to be produced.

Yet another object of the invention is to provide a valve driving apparatus which can be widely used for an engine having totally five valves.

A further object of the present invention is to provide a valve driving apparatus for use of an engine in which one valve of three-valves configuration having a valve stem having an upper end disposed closest to the other two-valves configuration is adapted to be driven by a cam shaft located on the same side as the two-valves configuration, such that an arm length of a swing arm for driving said one valve can be shortened.

It is still another object of the present invention to provide a valve driving apparatus for use of an engine in which any two valves of the three-valves configuration have different inclination angle such that layout allowability of the valve system is increased.

In one aspect, the invention provides a valve driving apparatus for use of an engine comprising an intake valve for opening and closing an intake port, an exhaust valve for opening and closing an exhaust port, and intake and exhaust cam shafts for driving the intake and exhaust valves respectively. At least one of the intake and exhaust valves is adapted to be driven by a cam shaft located on the other side with respect thereto.

In another aspect, the invention provides a valve driving apparatus for use of an engine comprising intake valves for opening and closing intake ports of the engine, and exhaust valves for opening and closing exhaust ports of the engine. One of the intake and exhaust valves includes three valves configuration, and the other includes two valves configuration. Any two valves of the three valves configuration are separately driven by valve driving systems, while all valves of the two valves configuration are driven by a common valve driving system. A remaining valve of the three valves configuration is driven by a cam shaft located on the other side with respect thereto.

In a preferred embodiment of the invention, the remaining valve of the three valves configuration is positioned at an end of the three valves configuration such that the remaining valve is spaced far away from a center of a cylinder bore.

In another preferred embodiment of the invention, the remaining valve of the three valve configuration comprises a valve having constant valve timing and valve lift regardless of driving state of the engine.

In still another preferred embodiment of the invention, the intake valves comprise three valves configuration and the exhaust valves comprise two valves configuration.

In yet another preferred embodiment of the invention, the remaining valve of the three valves configuration is positioned such that an upper end of a valve stem thereof is disposed closer to the two valves configuration than upper ends of valve stems of the other two valves of the three valves configuration.

In another preferred embodiment of the invention, any two valves of the three valves configuration have valve stems having different inclination angle.

DESCRIPTION OF THE PREFERRED EMBODIMENTS

A preferred embodiment in accordance with the invention will be explained hereinbelow with reference to drawings.

Figure 1:
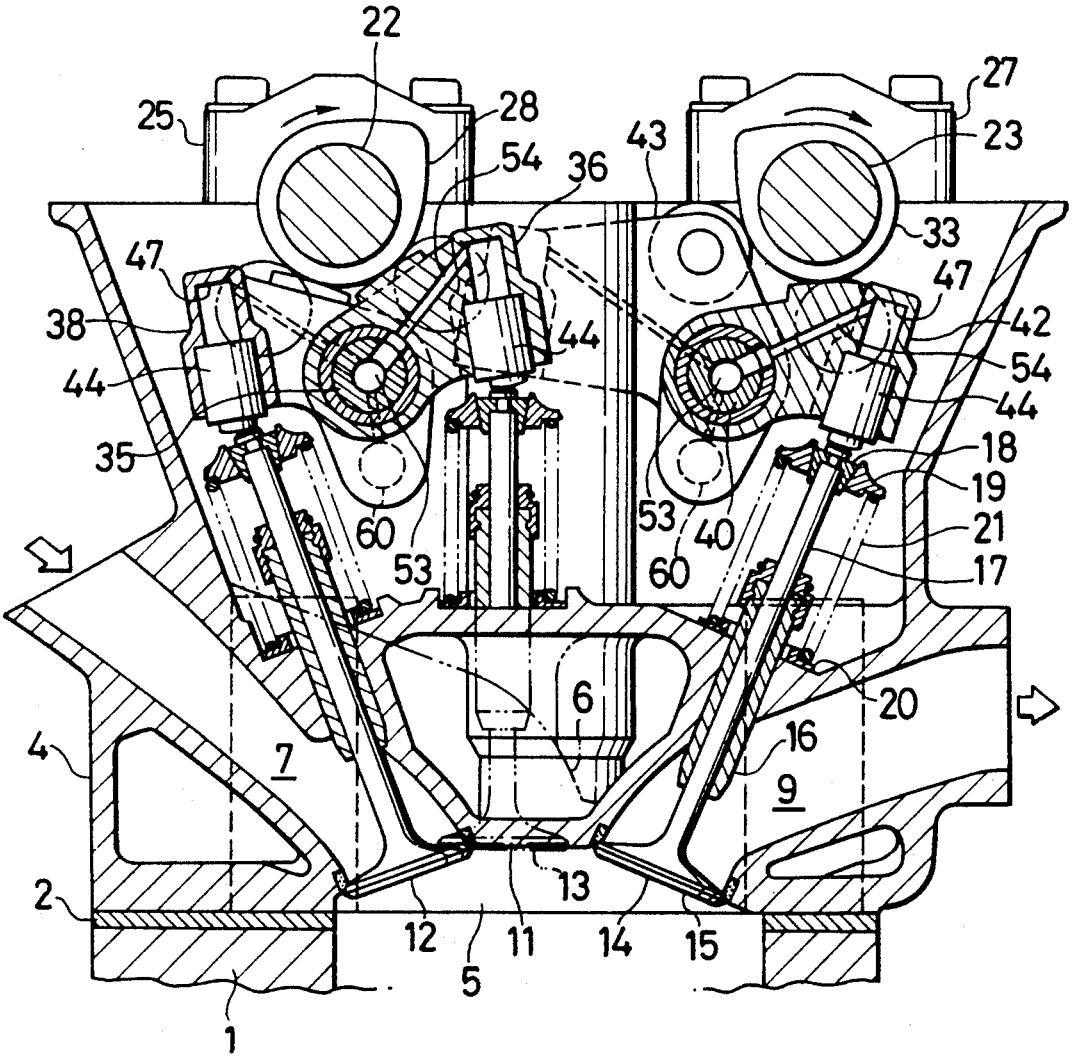
FIG. 1 is a cross-sectional view of a valve driving apparatus for use of an engine in accordance with the invention.
Figure 2:
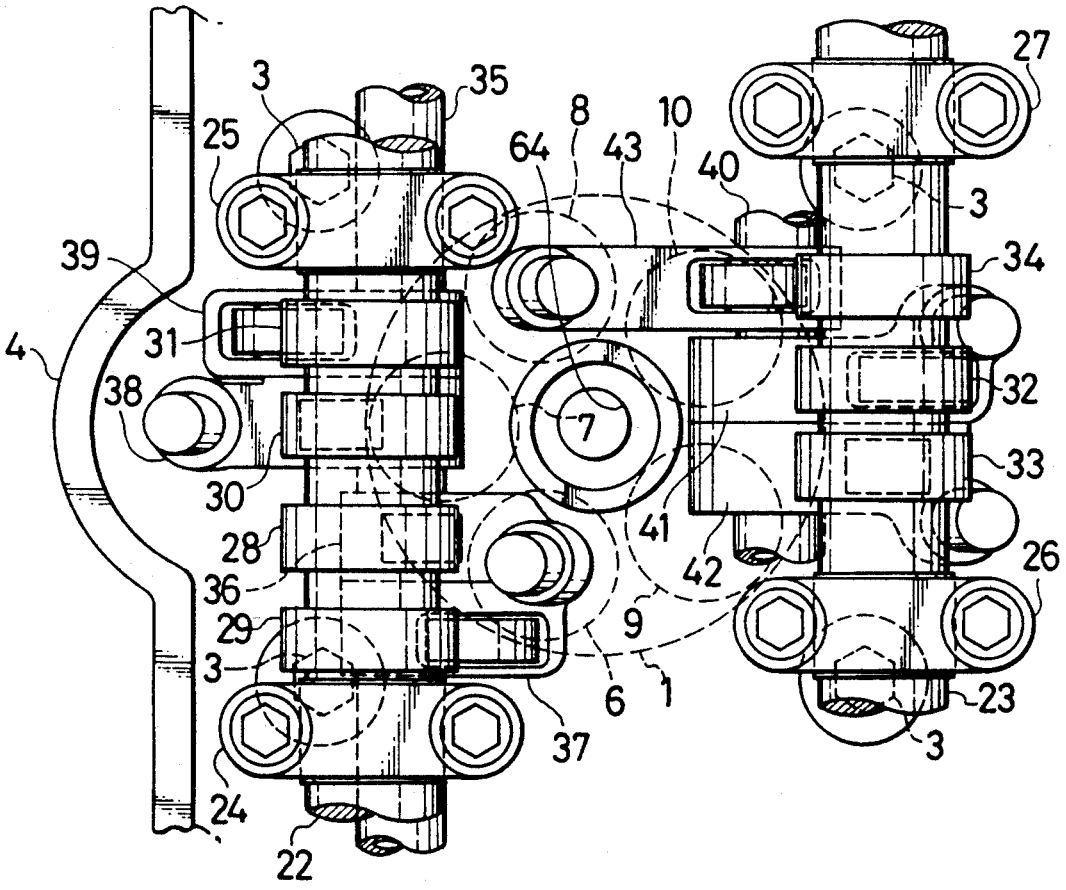
FIG. 2 is a top plan view illustrating the valve driving apparatus shown in FIG. 1.

A valve driving apparatus in accordance with the invention is illustrated in FIGS. 1 and 2. A cylinder head 4 is secured to a cylinder block 2 having a cylinder bore 1 therein by means of four bolts 3 for each cylinder. The cylinder head 4 is provided with three intake ports 6, 7, 8 and two exhaust ports 9, 10 each in communication with a combustion chamber 5.

The valve driving apparatus includes an intake valve 11 for opening and closing the intake port 6, an intake valve 12 for opening and closing the intake port 7, an intake valve 13 for opening and closing the intake port 8, which valve 13 is overlapped with the intake valve 11 in FIG. 1, an exhaust valve 14 for opening and closing the exhaust port 9, and an exhaust valve 15 for opening and closing the exhaust port 10, which valve 15 is overlapped with the exhaust valve 14 in FIG. 1. Thus, the valve driving apparatus has five valves consisting of three intake valves and two exhaust valves.

Each valves 11 to 15 has valve stems 17 fit into valve guides 16 provided on the cylinder head 4. Spring retainers 19 are fit into the valve stems 17 at the upper ends thereof through collets 18. Between the upper spring retainers 19 and a lower spring retainers 20 provided on the cylinder head 4 are disposed valve springs 21.

Intake cam shaft 22 and exhaust cam shaft 23 each extending along cylinder banks are supported by camshaft bearings 24, 25 and camshaft bearings 26, 27 respectively. The camshaft bearing 26 for the exhaust cam 23 is disposed closer to the center of the cylinder bore 1 than the camshaft bearing 24 facing the bearing 26, while the camshaft bearing 27 for the exhaust camshaft 23 is disposed further spaced away from the center of the cylinder bore 1 than the camshaft bearing 25 facing the bearing 27.

The intake camshaft 22 is provided with a cam 28 used during the engine runs at relatively low speed and a cam 29 used during the engine runs at relatively high speed, both cams 28 and 29 being associated with the intake valve 11, and a cam 30 used during the engine runs at relatively low speed and a cam 31 used during the engine runs at relatively high speed, both cams 30 and 31 being associated with the intake valve 12, while the exhaust valve 23 is provided with a cam 32 used during the engine runs at relatively low speed and a cam 33 used during the engine runs at relatively high speed, both cams 32 and 33 being associated with the exhaust valves 14 and 15, and a cam 34 associated with the intake valve 13. Among these five valves, the intake valve 13 which is disposed at an end of the arrangement of three valves 11, 12, 13 is adapted to be driven by the cam shaft 23 disposed at the opposite side with respect to the intake valves. When five valves system including three intake valves and two exhaust valves is adopted, the intake valve's side tends to have less space than the exhaust valve's side, since greater number of elements are positioned at the intake valve's side. Therefore, in the invention, the intake valve 13 located in less space is adapted to be driven by the exhaust cam shaft located in larger space.

Figure 3:
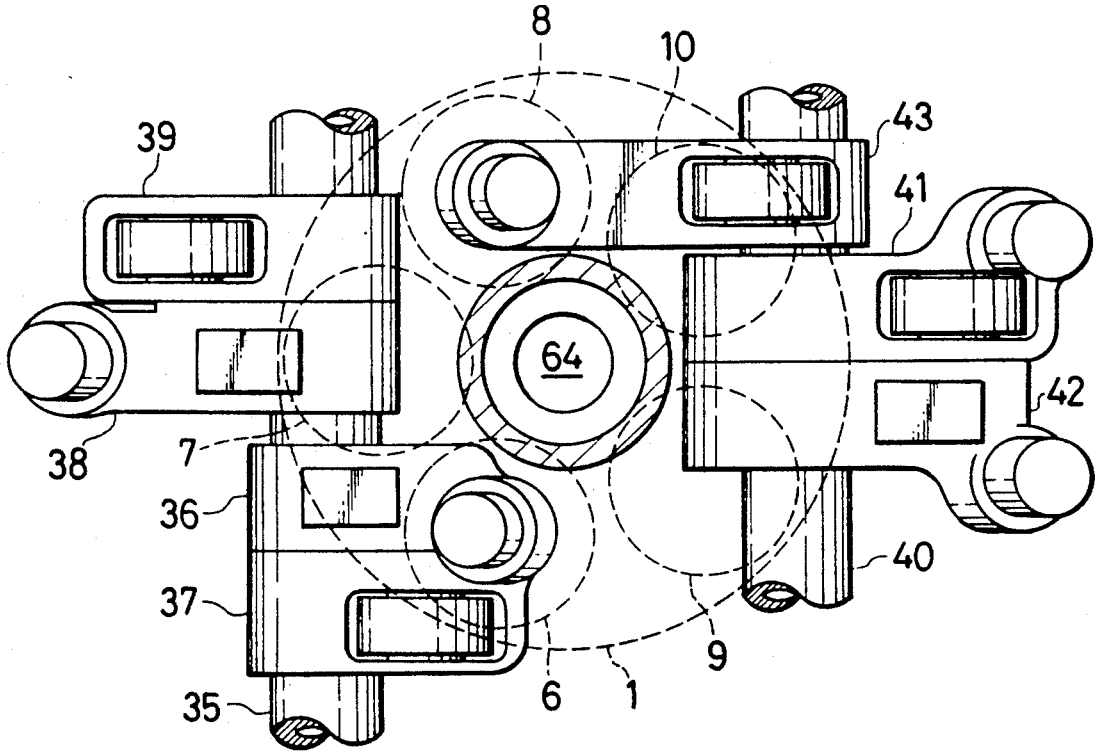
FIG. 3 is a top plan view illustrating the valve driving apparatus shown in FIG. 1 with cam shafts being removed for the purpose of clarification.

Below the intake camshaft 22 is disposed a rocker shaft 35 parallel with the intake camshaft 22, as shown in FIG. 3, which shaft 35 is provided with swing arms 36, 37, 38, 39 each driven by the cams 28, 29, 30, 31, while below the exhaust camshaft 23 is disposed a rocker shaft 40 parallel with the exhaust camshaft 23, as also shown in FIG. 3, which shaft 40 is provided with swing arms 41, 42, 43 each driven by the cams 32, 33, 34.

Between swinging ends of the swing arms and the upper ends of the valve stems 17 of the valves 11 to 15 are provided hydraulic lash adjusters (HLA) 44 for adjusting valve clearances.

Figure 4:
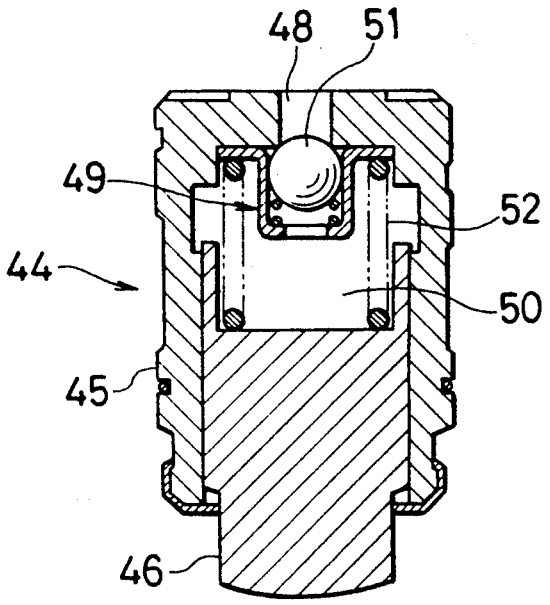
FIG. 4 is a cross-sectional view of a hydraulic lash adjuster (HLA).

With reference to FIG. 4, HLA 44 includes a body 45, a plunger 46 housed in the body 45, a high pressure chamber 50 in communication with oil reservoir 47 (see FIG. 1) through a oil passage 48 and a check valve 49, a check ball 51 comprising the check valve 49, and a plunger spring 52. The swing arms push the body 45 of HLA 44 when the intake and exhaust valves open and thereby the plunger 46 is also pushed due to reaction force from the valve stems 17. Then, high pressure is produced in the high pressure chamber 50, so that the check ball 51 closes the oil passage 48 with the result of increasing pressure in the high pressure chamber 50. Thus, since the oil is not changed in volume, the body cooperates with the plunger 46 to push the intake and exhaust valves down.

After the intake and exhaust valves are closed, the swing arms push the body 45 of HLA 44 with less force than before and thereby the pressure in the high pressure chamber 50 decreases. Then, the check ball 51 is pushed down due to the oil pressure deriving from the oil reservoir 47, so that the oil is introduced into the high pressure chamber 50. The combination of the oil pressure and the spring force of the plunger spring 52 forces the body 45 to contact the swing arm, and also forces the plunger 46 to contact the valve stem 17, such that the valve clearance is adjusted to be zero. The oil flowing to the oil reservoir 47 is supplied through an oil passage 53 extending axially with the rocker shafts 35, 40 and an oil passage 54 formed in the swing arms.

The valves 11 and 12 among the three intake valves comprise adjustable valves capable of varying valve timing and valve lift in accordance with the engine-driven state. The valves 11 and 12 are separately driven by valve adjusting mechanism.

The remaining valve 13 comprise an unadjustable valve which has constant valve timing and constant valve lift regardless of the engine-driven state. The valve 13 is driven by the cam shaft 23 located on the opposite side to the valve 13.

The exhaust valves 14 and 15 are driven by a common valve adjusting mechanism.

Since aforementioned all valve adjusting mechanism has identical structure, only a valve adjusting mechanism 55 is explained hereinbelow.

Figure 5:
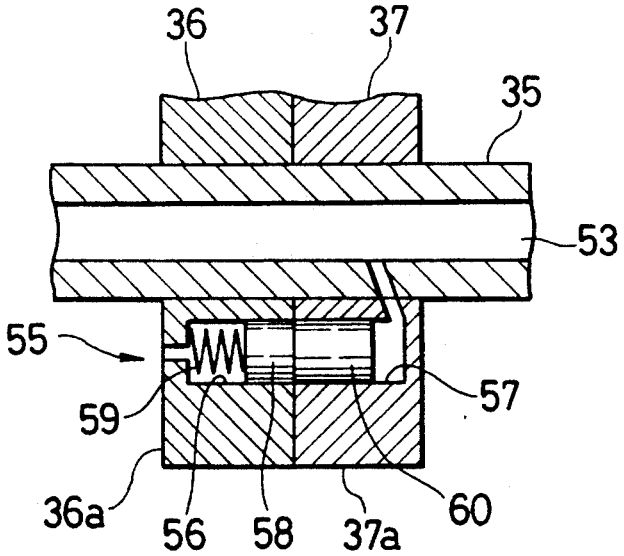
FIG. 5 is a schematic view illustrating a valve shifting mechanism.

As illustrated in FIG. 5, the swing arms 36, 37 have extended portions 36*a*, 37*a* integrally formed with the swing arms 36, 37 across the rocker shaft 35. These extended portions 36*a*, 37*a* have piston chambers 56, 57 respectively, which chambers 56, 57 are arranged to be aligned.

The piston chamber 56 has a first piston 58 and a spring 59 housed therein, while the piston chamber 57 has a second piston 60 housed therein. The piston chamber 57 is in communication with the oil passage 53.

When pressurized oil is not supplied to the piston chamber 57, the pistons 58, 60 maintain their positions as shown in FIG. 5 and the intake valve 11 is driven by the swing arm 36 for use during the engine runs at low speed. On the other hand, when pressurized oil is supplied to the piston chamber 57, the second piston 60 moves to the left as viewed in FIG. 5 to connect the swing arm 36 with the swing arm 37, with the result that the intake valve 11 is driven by the swing arm 37 for use during high speed.

Figure 6:
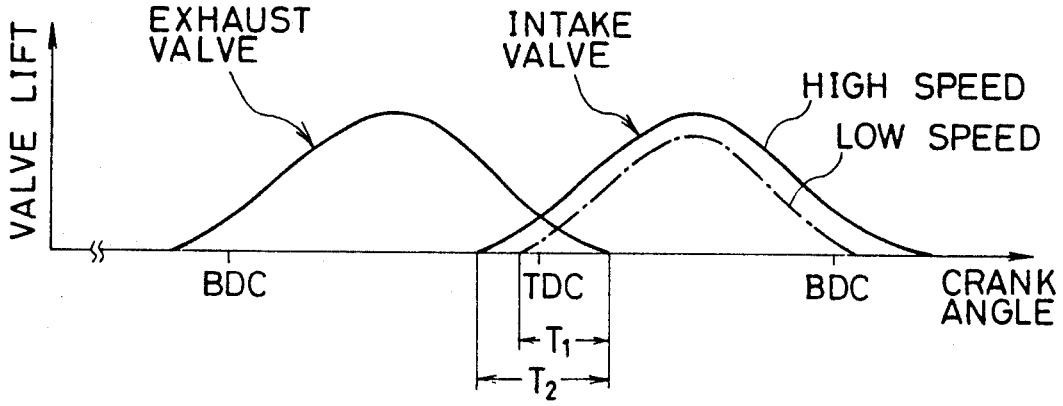
FIG. 6 is a graph showing how valve timing and valve lift is controlled by the valve shifting mechanism.

In other words, when pressurized oil is not supplied to the piston chamber 57, the cam 28 of the intake cam shaft 22 for use of low speed is selected to use, with overlapping period $T_1$ in which both the intake valves and the exhaust valves open being relatively short, as shown in FIG. 6. When pressurized oil is supplied to the piston chamber 57, the cam 29 of the intake cam shaft 22 for use of high speed is selected to use, with overlapping period $T_2$ being relatively long, as shown in FIG. 6.

Figure 7:
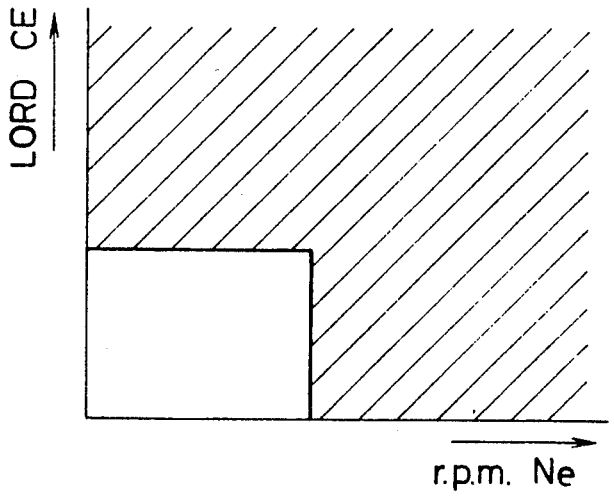
FIG. 7 is schematic view showing an area in which the valve shifting mechanism is operated.
Figure 8:
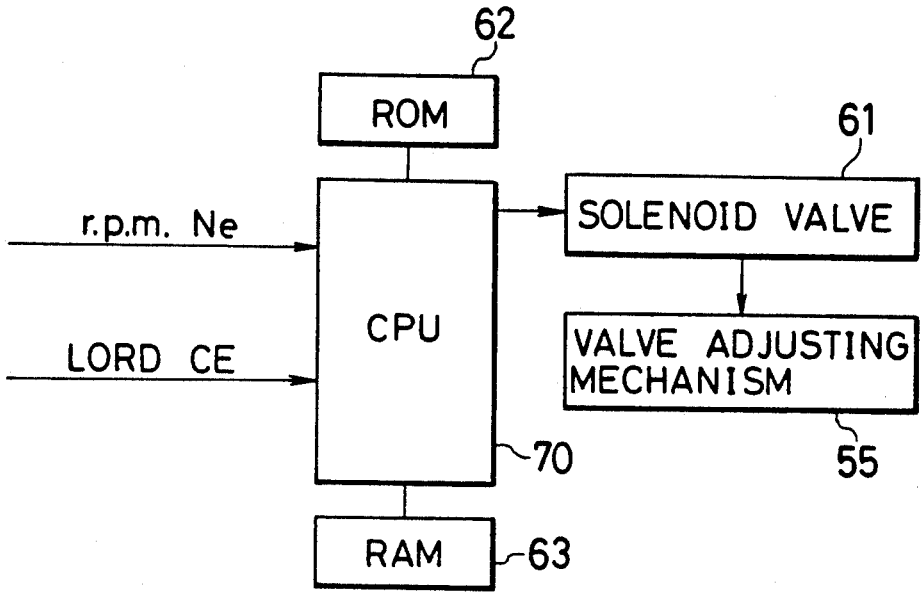
FIG. 8 is a block diagram for controlling the valve shifting mechanism.

The valve adjusting mechanism 55 is operated in a slant-lined zone shown in FIG. 7 by selecting a cam for use of high speed, which zone represents that the engine rotates at high r.p.m and/or the engine has high load. For this purpose, the oil passage 53 for supplying pressurized oil with the piston chamber 57 is provided with a solenoid valve 61, as illustrated in FIG. 8. The solenoid valve 61 is controlled by CPU 70.

CPU 70 receives signals representing engine r.p.m Ne and engine load CE to thereby control the valve adjusting mechanism 55 via the solenoid valve 61 in accordance with a program stored in ROM 62. RAM 63 stores required data.

Figure 9:
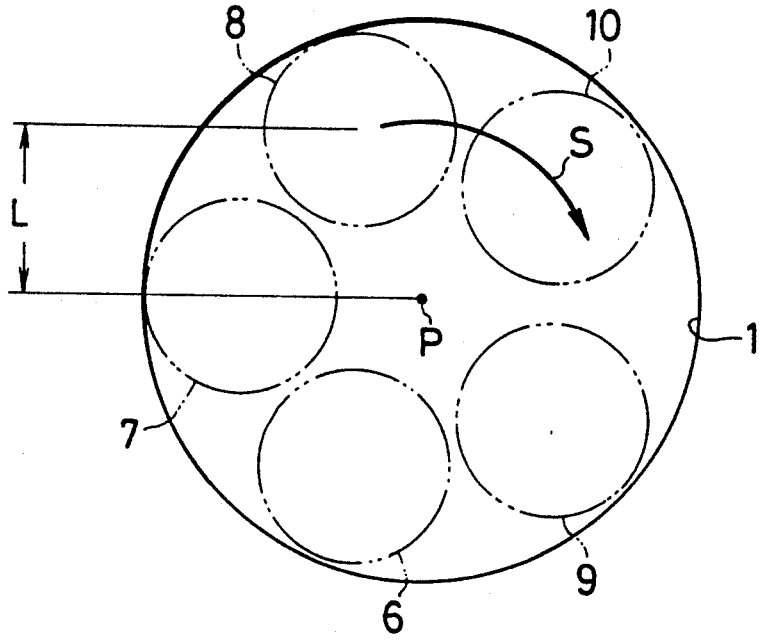
FIG. 9 is a schematic view illustrating layout of intake and exhaust ports relative to a cylinder bore and the birth of swirls.

The valve 13 is positioned at an end of three intake valves configuration to have longer distance L (see FIG. 9) from the center P of the cylinder bore 1 than the other two intake valves 11 and 12, and comprises a valve having constant valve timing and valve lift, such that swirl S is facilitated to create as illustrated in FIG. 9 to increase combustion speed during low load and low r.p.m. to thereby maintain the combustion in the engine stable.

Furthermore, the valve 13 has a valve stem having an upper end located to be closer to the exhaust valves than the other two intake valves 11, 12. In this embodiment, though both the intake valves 11 and 13 have valve stems having upper ends located to be closer to the exhaust valves than the intake valve 12, the valve to be driven by the exhaust cam shaft 23 is selected to be one which is located to be closest to the exhaust valves among a plurality of intake valves.

As illustrated in FIG. 1, the intake valves 11 and 12 have different inclination angles. In this embodiment, the intake valve 11 has 0 degree of inclination angle with respect to a vertically extending axis passing the center P of the cylinder bore 1, while the intake valve 12 has 19.5 degrees of inclination angle and the exhaust valves 14 and 15 have about 23 degrees of inclination angles. Thus, larger space can be obtained above the valve stems of the intake valves 11 and 12 due to the aforementioned valve arrangement, and thereby the valve adjusting mechanism 55 can be disposed in that space. A reference numeral 64 represents a plug hole for inserting a ignition plug thereinto.

It should be noted that those skilled in the art can easily recognize that this embodiment and thus the present invention can achieve all the aforementioned objects.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A valve driving apparatus of an engine comprising:

a plurality of intake valves for opening and closing intake ports;

a plurality of exhaust valves for opening and closing exhaust ports;

intake and exhaust cam shafts for driving said intake and exhaust valves; and at least one of said intake and exhaust valves being adapted to be driven by a cam shaft located on a side of the valve driving apparatus opposite to the at least one of said intake and exhaust valves.

2. A valve driving apparatus of an engine comprising:

intake valves for opening and closing intake ports of the engine;

exhaust valves for opening and closing exhaust ports of the engine;

one of said intake and exhaust valves being a three valve configuration, the other being a two valve configuration;

any two valves of said three valve configuration being separately driven by valve driving systems;

all valves of said two valve configuration being driven by a common valve driving system;

a remaining valve of said three valve configuration being driven by a cam shaft driving the two valve configuration.

3. A valve driving apparatus in accordance with claim 2, wherein said remaining valve of the three valve configuration is positioned at an end of the three valve configuration such that said remaining valve is spaced far away from a center of a cylinder bore.

4. A valve driving apparatus in accordance with claim 3, wherein said remaining valve of the three valve configuration comprises a valve having constant valve timing and valve lift regardless of engine driving state.

5. A valve driving apparatus in accordance with claim 2, wherein said intake valves comprise the three valve configuration and said exhaust valves comprise the two valve configuration.

6. A valve driving apparatus in accordance with claim 2, wherein said remaining valve of the three valve configuration is positioned such that an upper end of a valve stem thereof is disposed closer than upper ends of valve stems of the other two valves of the three valve configuration to said two valve configuration.

7. A valve driving apparatus in accordance with claim 2, wherein any two valves of the three valves configuration have valve stems having different inclination angle.

* * * * *